US005226984A

United States Patent [19]

Hamada et al.

[11] Patent Number: 5,226,984

[45] Date of Patent: Jul. 13, 1993

[54] PROCESS OF PREPARING FE-CR-NI-AL FERRITIC ALLOYS

[75] Inventors: Tadashi Hamada, Sakai; Shuji Yamada, Ashiya; Eiji Tsuji, Suita; Tomoyuki Mizukoshi, Nose, all of Japan

[73] Assignee: Matsushita Electric Works, Ltd., Osaka, Japan

[21] Appl. No.: 818,084

[22] Filed: Jan. 8, 1992

Related U.S. Application Data

[62] Division of Ser. No. 604,231, Oct. 19, 1990, Pat. No. 5,089,223.

[30] Foreign Application Priority Data

Nov. 6, 1989 [JP] Japan ..... 1-289658

[51] Int. Cl.[5] ..... C21D 6/00

[52] U.S. Cl. ..... 148/606

[58] Field of Search ..... 148/606

[56] References Cited

FOREIGN PATENT DOCUMENTS 57-39159 3/1982 Japan .

*Primary Examiner*—Deborah Yee

*Attorney, Agent, or Firm*—Stevens, Davis, Miller & Mosher

[57] ABSTRACT

Fe-Cr-Ni-Al ferritic alloy capable of forming hot oxidation/corrosion resistive aluminum oxide scale in the surface thereof by exposure to oxidation environments at elevated temperatures. Due to the ferritic structure, the aluminum oxide scale is formed uniformly and densely to improve scale adherence, or prevent scale flaking. The mechanical properties of the ferritic alloy is considerably improved by incorporation of controlled amounts of Cr, Ni, and Al relative to each other, which are added to precipitate minute Ni-Al intermetallic compounds in the alloy matrix while retaining the ferritic structure. Such minute Ni-Al intermetallic compounds are thought to be responsible for improved mechanical properties, including high temperature strength, tensile strength, hardness and the like. Whereby, the alloy combine excellent hot oxidation/corrosion resistance and improved mechanical properties.

1 Claim, 5 Drawing Sheets

PROCESS OF PREPARING FE-CR-NI-AL FERRITIC ALLOYS

This is a divisional of application Ser. No. 07/604,231 filed Oct. 19, 1990, now U.S. Pat. No. 5,089,223.

BACKGROUND OF THE INVENTION

1. Field of the Invention

The present invention is directed to Fe-Cr-Ni-Al ferritic alloys capable of forming a hot oxidation resistive scale of aluminum oxides (chiefly composed of alumina $Al_2O_3$) under hot oxidation atmospheres, and more particularly to such Fe-Cr-Ni-Al ferritic alloys combining excellent hot oxidation resistance and improved tensile strength, 0.2% yield strength, elongation, and hardness.

2. Description of the Prior Art

Hot oxidation resistive alloys forming an aluminum oxide scale under hot oxidation atmospheres have been proposed in the art which include Fe-Cr-Al ferritic alloys as disclosed in Japanese Patent Early Publication Nos. 54-141314 and 60-262943, and Fe-Ni-Cr-Al austenitic alloys as disclosed in Japanese Early Patent Publication Nos. 52-78612 and 62-174352. The Fe-Cr-Al ferritic alloys have rather poor mechanical strength nearly equal to ferritic stainless steels and are not expected to remarkably improve the strength even with known heat treatment. Further, in order to form an aluminum oxide (alumina $Al_2O_3$) scale of the order of several micrometer ($\mu$m) in thickness, the Fe-Cr-Al ferritic alloys should be exposed to high temperature of above 1100° C. for several hours or more. During this heat treatment, the alloy suffers from critical grain growth which reduces the mechanical strength to an unacceptable level for use as a material requiring high mechanical strength. On the other hand, the prior Fe-Ni-Cr-Al austenitic alloys are difficult to provide a uniform alumina ($AlO_3$) scale and suffer from a poor scale adherence or flaking of the alumina scale.

SUMMARY OF THE INVENTION

The above insufficiencies and problems have been eliminated in the present invention which provides an improved Fe-Cr-Ni-Al ferritic alloy with improved properties. In accordance with the present invention, the Fe-Cr-Ni-Al ferritic alloy consists essentially of by weight, 25 to 35 percent chromium; 15 to 25 percent nickel; 4 to 8 percent aluminum; 0.05 to 1.0 percent at least one element selected from the group consisting of zirconium, hafnium, cerium, lanthanum, neodymium, gadolinium; 0 to 0.1 percent yttrium; and balance iron. When heated in a hot oxidation atmosphere, the alloy of the present invention forms a protective dense scale of an aluminum oxide chiefly composed of alumina $Al_2O_3$ which exhibits strong adherence to a remaining substrate or matrix as well as remarkably improved high-temperature or hot oxidation/corrosion resistance.

The alloy is characterized to have a ferritic structure and include uniformly precipitated minute intermetallic Ni-Al compounds which are responsible for increased scale adherence and outstandingly increased toughness. In order to successfully provide such protective scale, the heating is carried out preferably in the temperature range of 800° C. to 1300° C. This is because that below 800° C., the alloy fails to provide a uniform $Al_2O_3$ scale over the entire surface thereof, and that above 1300° C., the alloy matrix or substrate become brittle. The above heating is also preferred to continue for a time period of over 0.5 hour, since an uneven or unacceptable alumina scale may be sometimes formed with less than 0.5 hour. Despite that the prior hot oxidation resistive Fe-Cr-Al alloys exhibit rather poor high-temperature strength due to its ferritic structure, the ferritic alloy of the present invention can be given improved high-temperature strength matching with austenitic heat resisting steels as well as improved hardness due to the presence of the intermetallic Ni-Al compounds. Also by the presence of the uniformly diffused intermetallic Ni-Al compounds, the alloy of the present invention can be restrained from coarse-graining when subjected to the high temperature heat treatment of forming the alumina $Al_2O_3$ scale, and therefore can see no substantial reduction in mechanical properties at such high temperature heat treatment to thereby retain improved toughness. The aluminum oxide scale also retains improved corrosion resistance against corrosive gas or liquid.

It is therefore a primary object of the present invention to provide an Fe-Cr-Ni-Al ferritic alloy which is capable of forming hot oxidation and corrosion resistive aluminum oxide scale by high temperature heat treatment, yet assuring improved mechanical strength, hardness, and scale adherence.

In order to give a ferritic structure, which is found advantageous to provide the dense protective scale with increased scale adherence, to a ferrous alloy containing a large quantity of austenite forming elements Ni, in addition to ferrite forming elements Cr and Al, the proportion of the elements can be carefully controlled in view of the following considerations.

Al is included to form the alumina $Al_2O_3$ scale in the surface of the alloy by exposure to hot oxidation environments and at the same time to precipitate the Ni-Al intermetallic compounds. Al content is preferred to be not less than 4% by weight for obtaining uniform and dense protective $Al_2O_3$ scale and Ni-Al compounds sufficient to improve the mechanical properties of the alloy. Although more amount of Al may be advantageous to form the scale and the Ni-Al intermetallic compounds, the alloy suffers from lowered workability at Al weight percent above 8%. Therefore, Al content is preferred to be within a range of 4% to 8% by weight.

Ni is included to precipitate the Ni-Al intermetallic compounds with the Al. Ni content is preferred to be not less than 15% by weight for obtaining the Ni-Al intermetallic compounds sufficiently precipitated in the matrix of the alloy for improving the mechanical properties thereof. However, the content increase of Ni as the austenite forming element should require correspondingly increased content of Cr or Al as the ferrite forming elements such that the alloy can be basically of ferritic structure for the reason as described in the above. Above 25% by weight of Ni, it is required to increase Cr content to an unacceptable level where the alloy becomes critically brittle. Therefore, Ni content is preferred to be within a range of 15% to 25% by weight.

Cr is essential to form the dense and uniform $Al_2O_3$ scale in the surface of the ferrous alloy. In order to give the ferritic structure in cooperation with also the ferrite forming element Al in the presence of relatively large quantity of the austenite forming element Ni, at least 25% by weight of Cr is required for the lowermost Ni content (15%) and the uppermost Al content (8%). The upper limit of Cr content is set to 35% by weight since the alloy becomes critically brittle with Cr content of above 35%. Therefore, Cr content is selected to be within the range of 25 to 35% by weight.

Other elements including titanium group elements such as zirconium Zr, yttrium Y, and hafnium Hf, as well as rare-earth elements such as cerium Ce, lanthanum La, neodymium Nd, and gadolinium Gd may be added to improve the brittleness of the $Al_2O_3$ scale, in addition to that such element or elements form oxides which are diffused in the matrix of the alloy immediately below the scale to greatly improve scale adherence. In order to achieve these effects, 0.05% by weight in total of one or more of Zr, Hf, Ce, La, Nd, and Gd and a small amount of the Y are found necessary. Either when total content of such elements excluding yttrium exceeds 1.0% or when the Y content exceeds 0.1%, the resulting alloy will suffer from abrupt reduction in workability. Accordingly, the alloy is selected to contain 0.05 to 1.0 percent at least one element selected from the group consisting of zirconium, hafnium, cerium, lanthanum, neodymium, gadolinium, and contain not more than 0.1 percent yttrium.

Preferably, the ferritic alloy of the present invention may contain up to 0.5% by weight of titanium as it facilitate to form more minute intermetallic compounds by suitable heat treatment which are effective to improve toughness of the alloy. Above 0.5%, the titanium acts adversely to lessen the scale adherence and fail to provide the dense structure of $Al_2O_3$.

The alloy of the present invention should not be understood to eliminate other elements or impurities inevitably present in this kinds of alloys in small amounts. Among the impurities, however, silicon Si, carbon C, and nitrogen N are preferably controlled to have a limited content for the reason as discussed below. Si becomes, at the hot oxidation treatment of forming the $Al_2O_3$ scale, oxides $SiO_2$ which will intermingle into the scale to thereby degrade the dense structure thereof. In this regard, Si content is found in the present invention to be not more than 0.3% by weight.

C reacts, when exposed to high temperature, with Cr to form chromium carbides which will make the alloy more brittle, in addition to that C forms $CO_2$ gas which will break the $Al_2O_3$ scale. Further, C will react readily with the rare-earth elements to thereby reduce the intended effect of increasing the scale adherence by the addition of such rare-earth element or elements. In this regard, C content is found to be not more than 0.01% by weight. N will reduce the toughness and react, at the high temperature treatment, with Cr to form chromium nitrides which may cause the alloy to make brittle. In this regard, N content is found to be not more than 0.015% by weight.

As discussed in the above, the Fe-Cr-Ni-Al of the present invention is characterized to comprise the ferritic structure, but it may include not more than 5% by volume of austenitic structure without substantially degrading the above properties and without failing to provide the uniform $Al_2O_3$ scale.

The mechanical properties of the alloy can be further enhanced in the present invention by sophisticated heat treatment as discussed in the following Examples, to present the hot oxidation/corrosion resistive ferrous material with enhanced mechanical strength.

Because of the excellent hot oxidation/corrosion resistivity and improved mechanical properties, the Fe-Cr-Ni-Al alloy of the present invention can be best adapted in use as materials which, for example, include heat resistive elements, components for vehicle exhaust gas cleaning system, boiler members, valves for internal combustion engines, other members or components subject to hot oxidation/corrosion environments, or even as structural materials. Further, due to the increased hardness, the alloy of the present invention can be best utilized as cutting tools or elements including an inner cutter blade of a dry shaver, scissors, knifes, or the like. It should be of course understood that the alloy of the present invention is not limited to the above utilizations but may be used in any application fields.

Figure 1:
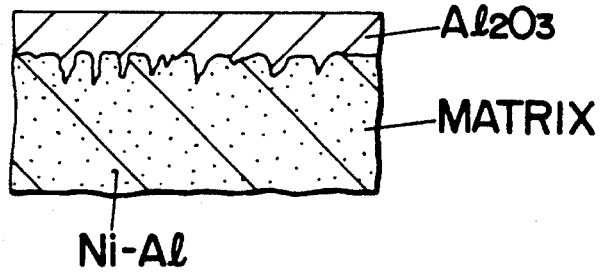
FIG. 1 is an enlarged sectional view schematically illustrating an oxide scale and a matrix of an Fe-Cr-Ni-Al ferritic alloy in accordance with the present invention.

The following examples and comparative examples show comparative results, but it is to be understood that these examples are given by way of illustration and not of limitation. All percentages are on a weight basis.

EXAMPLES 1 TO 8, COMPARATIVE EXAMPLES 1 TO 7, AND PRIOR ART

Specimen nos. 1 to 16 having compositions listed in Table 1 were melted in a high frequency induction vacuum furnace and hot rolled to provide specimens of 2 mm thick plates, respectively. In detail, for each specimen, pellets of electrolytic iron Fe, electrolytic chromium Cr and nickel Ni were melted within a crucible under a high vacuum of less than $5\times10^{-4}$ torr and also fractions of Al-Fe alloy, Fe-Zr alloy, Fe-Ti alloy, Hf and other rare-earth elements were also added to the molten metals. The resulting liquid solution was poured into a copper-mold within the furnace under the same vacuum level to obtain an ingot. The ingot was then heated to a temperature of 800 to 1100° C. to be forged followed by being rolled at the same temperature to provide the individual specimen. Specimen no. 17, which is representative of a prior art heat resistive steel SUH-660 (designated in accordance with the Japanese Industrial Standard), was commercially available test piece of 2 mm thick. These specimens nos. 1 to 17 were each cut into 2×15×20 mm piece which was then polished with Emery Paper #600 and heated to 1150° C. for 20 hours within a furnace at an atomspheric environment so as to form an oxide scale in the surface thereof.

TABLE 1

| | Specimen No. | Composition, weight % | | | | | | | | | | | | | | |
|---|---|---|---|---|---|---|---|---|---|---|---|---|---|---|---|---|
| | | Cr | Ni | Al | C | Si | N | Ti | Zr | Y | Hf | Ce | La | Gd | Nd | Fe |
| Example 1 | 1 | 30.8 | 20.7 | 5.6 | 0.005 | 0.08 | 0.010 | — | 0.19 | — | 0.05 | 0.05 | — | — | — | balance |
| Example 2 | 2 | 30.7 | 21.6 | 6.0 | 0.005 | 0.08 | 0.010 | 0.50 | 0.21 | — | — | — | — | — | 0.05 | balance |
| Example 3 | 3 | 27.5 | 17.5 | 5.4 | 0.005 | 0.08 | 0.010 | — | 0.15 | 0.06 | — | — | 0.05 | — | — | balance |
| Example 4 | 4 | 27.8 | 15.2 | 4.4 | 0.005 | 0.08 | 0.010 | 0.45 | 0.13 | — | 0.10 | 0.05 | 0.05 | — | 0.05 | balance |
| Example 5 | 5 | 25.8 | 15.1 | 4.9 | 0.005 | 0.08 | 0.010 | 0.49 | 0.20 | — | — | — | — | 0.05 | — | balance |
| Example 6 | 6 | 32.0 | 24.0 | 7.8 | 0.005 | 0.08 | 0.010 | 0.50 | 0.25 | — | — | — | 0.05 | — | — | balance |
| Example 7 | 7 | 34.2 | 22.5 | 6.0 | 0.005 | 0.08 | 0.010 | — | 0.32 | 0.07 | 0.05 | — | — | — | 0.05 | balance |
| Example 8 | 8 | 31.2 | 19.1 | 5.5 | 0.005 | 0.08 | 0.010 | — | 0.20 | — | 0.05 | — | — | 0.05 | — | balance |
| Comparative Example 1 | 9 | 24.4 | 26.1 | 5.6 | 0.005 | 0.08 | 0.010 | — | 0.21 | — | — | — | — | — | — | balance |
| Comparative Example 2 | 10 | 22.8 | 17.4 | 5.3 | 0.005 | 0.08 | 0.010 | — | 0.19 | — | — | 0.05 | — | — | — | balance |
| Comparative Example 3 | 11 | 29.2 | 22.9 | 3.8 | 0.005 | 0.08 | 0.010 | — | 0.19 | — | 0.05 | — | 0.05 | — | — | balance |
| Comparative Example 4 | 12 | 30.0 | 25.3 | 5.3 | 0.005 | 0.08 | 0.010 | — | 0.22 | 0.05 | 0.05 | — | — | — | 0.05 | balance |
| Comparative Example 5 | 13 | 24.3 | 21.1 | 5.1 | 0.005 | 0.08 | 0.010 | — | 0.20 | — | — | — | 0.05 | — | — | balance |
| Comparative Example 6 | 14 | 24.7 | 16.2 | 4.0 | 0.005 | 0.08 | 0.010 | 0.50 | 0.21 | — | — | — | — | — | 0.05 | balance |
| Comparative Example 7 | 15 | 23.1 | 15.1 | 6.1 | 0.005 | 0.08 | 0.010 | 0.50 | 0.21 | — | — | — | — | 0.05 | — | balance |
| Fe—Cr—Al prior art 1 | 16 | 30 | — | 3.2 | 0.005 | 0.08 | 0.010 | — | 0.20 | — | — | 0.05 | — | — | — | balance |
| SUH660 prior art 2 | 17 | 15.1 | 25.4 | 0.3 | 0.08 | 0.85 | 0.10 | 2.1 | — | — | — | — | — | — | — | balance |

Test 1: Composition and Scale Adherence

Specimens nos. 1 to 17, which correspond to Examples 1 to 8, Comparative Examples 1 to 7, and prior art 1 and 2, were examined with regard to the composition and scale adherence of the oxide scale. The results are shown in FIG. 2, where (◯) indicates the specimens of the Examples which form $Al_2O_3$ scales exhibiting excellent scale adherence, (X) indicates the specimens of the Comparative Examples which form Fe-Cr-Ni-Al mixture oxide scales suffering from partial flaking, and suffix numerals of the marks (◯) and (X) correspond to numbers of the Example 1 to 8 and the Comparative Examples 1 to 7.

Figure 2:
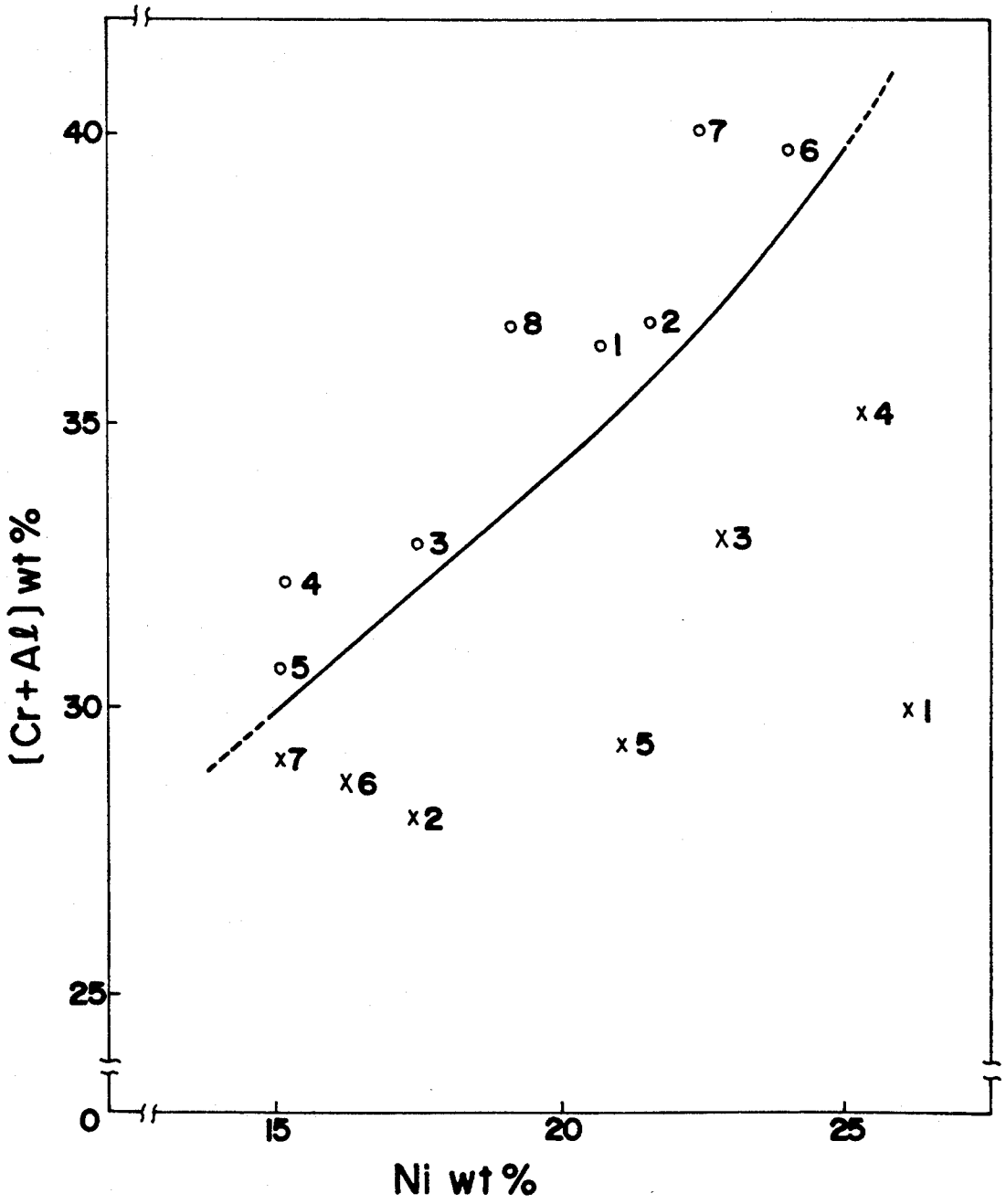
FIG. 2 is a graph illustrating a relationship between Ni content and (Cr+Al) content to enable the formation of an $Al_2O_3$ scale.
Figure 5A:
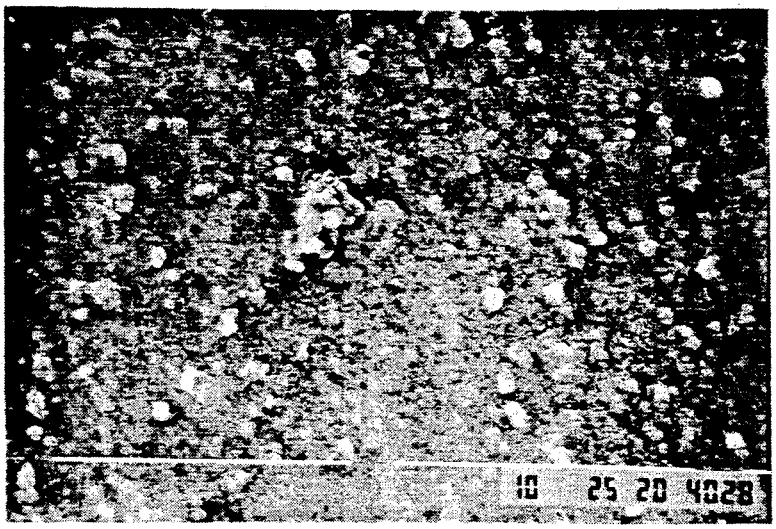
FIGS. 5A and 5B are photographs respectively for the surfaces of Example 1 and Comparative Example 3.

As known from FIG. 2, in order to obtain $Al_2O_3$ scale of excellent adherence with the composition within the prescribed content range described hereinbefore, it is required to increase (Cr+Al) content with increase of the Ni content to a point above the solid line in the figure. Specimens nos. 1 to 17 of thus selected compositions was determined by an X-ray diffraction analysis to have a ferritic structure and $Al_2O_3$ as chiefly composing the oxide scale. Specimen no. 1 was observed by a scanning electron microscope to present an image of an $Al_2O_3$ scale surface as shown in FIG. 5A which is a microphotograph at a magnification of 4200×. As seen in the figure, a dense and uniform scale is formed in the alloy surface. The same structure was seen over the entire surface and for the other specimens nos. 2 to 8. Cross-sections of the $Al_2O_3$ were examined also by the microscope for specimens nos. 1 to 8, which show a typical structure as illustrated in FIG. 1 in which Ni-Al intermetallic compounds are designated by dots. As seen in FIG. 1, a complicatedly serrated interface is formed between the oxide scale and the matrix for specimens nos. 1 to 8 as well as for specimen no. 16 of Fe-Cr-Al ferritic alloy, which interface demonstrates the improved scale adherence. Such oxide scales were proved not to be flaked off even when the alloys are quenched into the water from the high oxidation temperature.

Figure 5B:
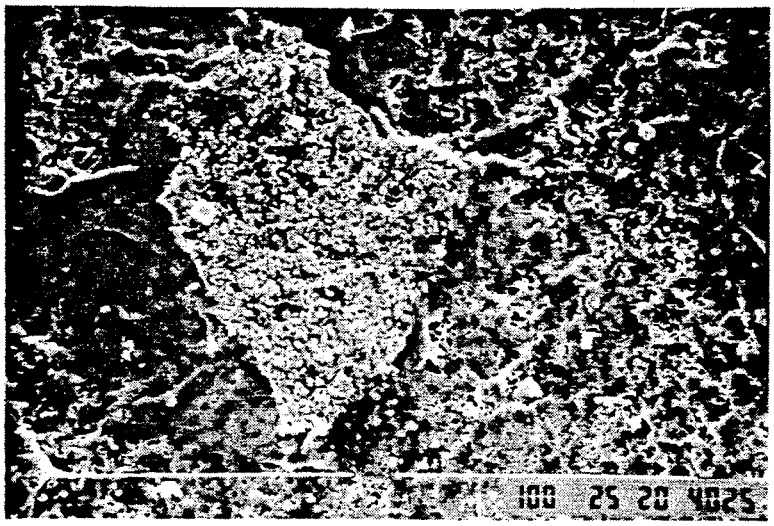

In contrast to the above, Comparative Examples 1 to 7 (specimens nos. 9 to 15) and prior art 2 (specimen no. 17) were found by the X-ray diffraction analysis to have austenitic structure or austenitic-ferritic composite structure with oxide scales composed of oxides of Cr, Ni, and Fe plus $Al_2O_3$. Also, these specimens are found to have insufficient scale adherence and scale flaking occurs when quenched from the high oxidation temperature to the room temperature. Such scale flaking is seen over substantially the entire region of the specimens, as typically shown in FIG. 5B which is a micrograph taken by the like microscope at a magnification of 4200× for specimen no. 22. From FIG. 5B, it is seen that the oxide scale remains adhered only at center diamond and are removed off from the other portion.

Test 2: Oxidation Resistance

Figure 3:
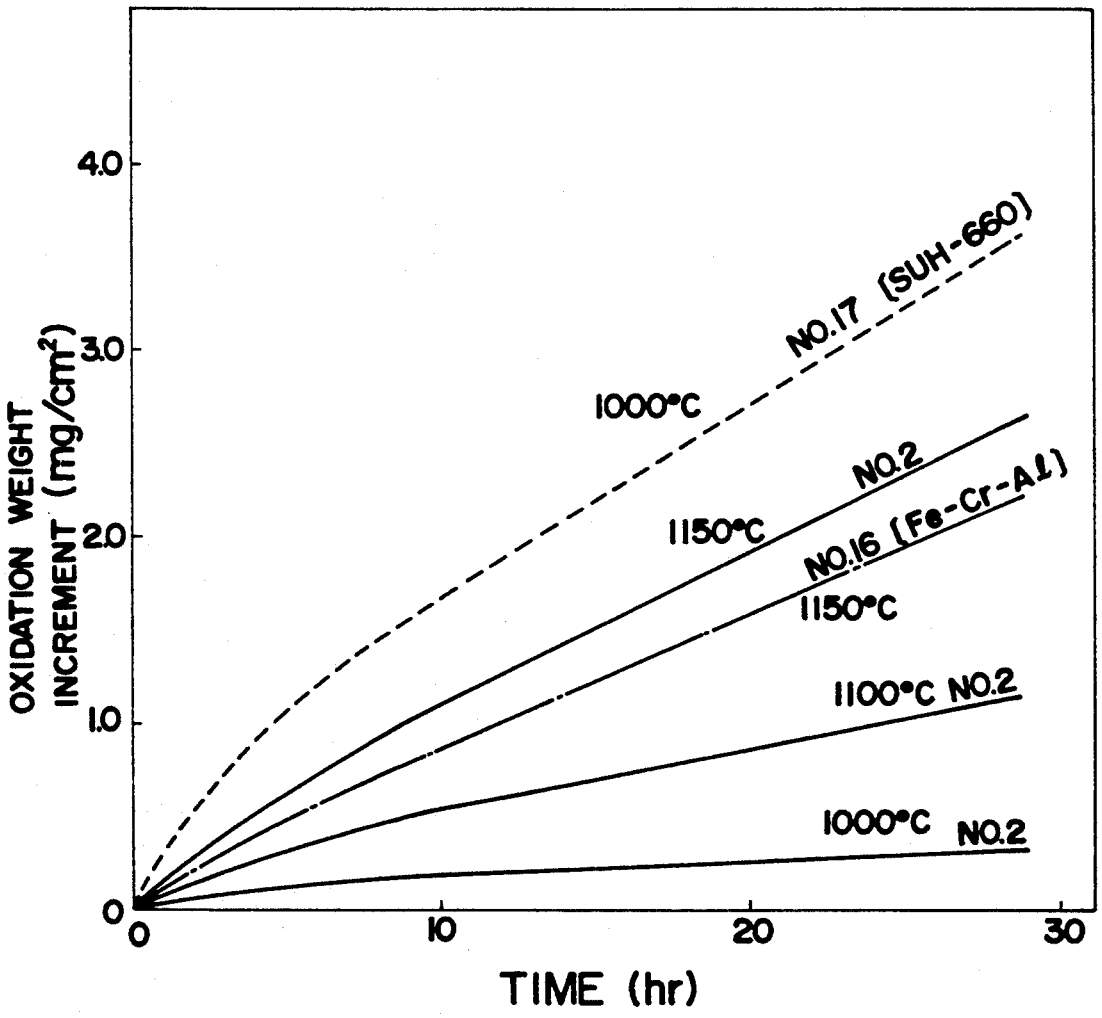
FIG. 3 is a graph illustrating a relation between oxidation time and oxidation weight increment of the alloys of different compositions and subjected to differing hot oxidation environments.

Oxidation weight increments were measured with regard to Example 2 (specimen no. 2), prior art Fe-Cr-Al ferritic alloy (specimen no. 16), and prior art heat resistive steel SUH-660 (specimen 17) after being heated to a temperature of 1000 to 1150° C. at the atmospheric condition. The results are illustrated in FIG. 3 in which solid lines stands for oxidation weight increment [mg/cm$^2$] of specimen no. 2; dot-and-dash line for that of specimen no. 16 [Fe-Cr-Al alloy]; and dash-line for specimen no. 17 [SUH-660], with the heated temperatures indicated adjacent the respective lines. As apparent from FIG. 3, Example 2 of the present invention shows a superior oxidation resistance matching with the Fe-Cr-Al ferritic alloy. It is also confirmed that the oxidation weight increment of Example 2 is as less as about one-ninth that of specimen no. 17 [SUH-660] when heated to a temperature of 1000° C. for 20 hours.

EXAMPLES 9 TO 12 AND COMPARATIVE EXAMPLES 8 TO 9

Alloys having the same compositions as specimens nos. 2, 3, 16 and 17 were heat treated under listed conditions in Table 2 to prepare specimens nos. 18 to 23 [corresponding to Examples 9 to 12 and Comparative Examples 8 and 9]. Note that these heat treatments were made for improving mechanical properties of the rolled alloys and not for providing the protective oxide scales.

TABLE 2

| | Specimen No. | composition | Heat Treatment Condition | 0.2% Yield Strength [kg/mm$^2$] | Tensile Strength [kg/mm$^2$] | elongation [%] |
|---|---|---|---|---|---|---|
| Example 9 | 18 | same as specimen No. 2 | Rolled at 950° C., only | 90 | 160 | 20 |

TABLE 2-continued

| | Specimen No. | composition | Heat Treatment Condition | 0.2% Yield Strength [kg/mm²] | Tensile Strength [kg/mm²] | elongation [%] |
|---|---|---|---|---|---|---|
| Example 10 | 19 | same as specimen No. 3 | Rolled at 950° C., only | 87 | 156 | 20 |
| Example 11 | 20 | same as specimen No. 2 | Rolled at 950° C.; + kept at 1000° C. for 0.5 hr in atmospheric condition followed by being air-cooled; + kept at 700° C. for 3 hours in atmospheric condition followed by being air-cooled | 104 | 140 | 15 |
| Example 12 | 21 | same as specimen No. 3 | Rolled at 950° C.; + kept at 1000° C. for 0.5 hr in atmospheric condition followed by being air-cooled; + kept at 700° C. for 3 hours in atmospheric condition followed by being air-cooled; | 97 | 127 | 18 |
| Comparative Example 8 | 22 | same as specimen No. 16 | Rolled at 800° C., only | 40 | 70 | 25 |
| Comparative Example 9 | 23 | same as specimen No. 17 | Kept at 982° C. for 1 hr followed by being oil-quenched; + kept at 719° C. for 15 hrs in atmospheric condition followed by being air-cooled | 61 | 93 | 16 |

Test 3: Mechanical Properties

Specimens nos. 18 to 23 were tested with regard to mechanical properties including 0.2% yield strength, tensile strength, and elongation to give test results as listed in Table 2. As apparent from Table 2, Examples 9 to 12 [specimen nos. 18 to 21] exhibit superior mechanical properties than Comparative Examples 8 and 9, or prior Fe-Cr-Al alloy [specimen no. 22] and aged austenitic heat resistive steel SUH-660 [specimen no. 23].

Test 4: Hardness

Figure 4:
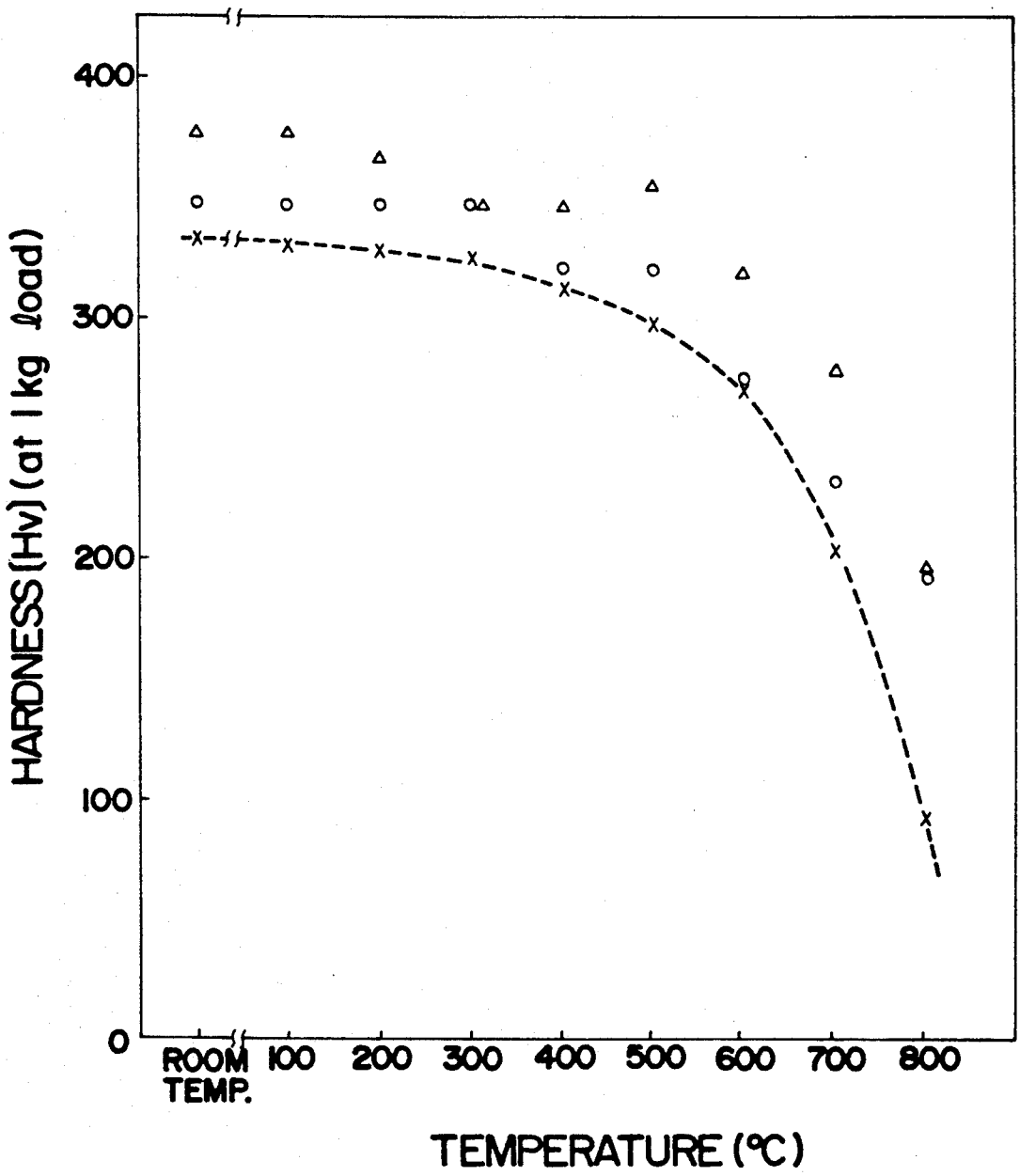
FIG. 4 is a graph illustrating hardness of Examples of the present invention and of the prior art at high temperatures, hardness [Hv] being plotted as measured at temperatures in abscissa.

Hardness at high temperatures were measured to specimen no. 2 at conditions before and after the heat treatment of forming the oxide scales and also to the heat resistive steel SUH-660 [specimen no. 23]. Specimen 2 was selected to be typical composition of the present invention. The results are shown in FIG. 4, where (○) represents hardness with regard to specimen no. 2 being air-cooled in the furnace from a temperature of 970° C.; (Δ) represents hardness with regard to specimen no. 2 when air-cooled from a temperature of 950° C. after it had been heat-treated at a hot oxidation temperature of 1150° C. for 16 hours in the furnace at an atmospheric condition followed by being water-cooled; and (X) represents hardness with regard to specimen no. 17 which was oil-quenched from a temperature of 982° C. followed by being air-cooled from a temperature of 719° C. It is known from FIG. 4 that the heat resistive steel SUH-660 [specimen no. 23] sees an abrupt hardness decrease above 600° C., while specimen no. 2 of the present invention can retain hardness of as much as 200 Hv even at an elevated temperature of 800° C. Since the alloys of the present invention exhibits remarkable hot oxidation resistance as demonstrated in the above Test 2, they can combine enhanced mechanical strength equal to or even superior to the austenitic heat resistive alloys, and the hot oxidations resistance matching with the Fe-Cr-Al ferritic alloys.

EXAMPLES 13 TO 20 AND COMPARATIVE EXAMPLES 10

Alloys of the same composition as specimens nos. 2, 3, and 16 were heat-treated at high oxidation temperature of 1150° C. for 15 hours to provide Examples 13 to 20 [specimen nos. 24 to 31] and Comparative Example 10 [specimen no. 32] in which the $Al_2O_3$ scales were formed. These specimens were subsequently subjected to post heat-treatments of listed condition in Table 3 and were then evaluated for the mechanical properties also listed in Table 3. Although no substantial difference in tensile strength is seen among specimens nos. 24 to 31, as apparent from Table 3, specimens nos. 28 to 31 with particular post heat treatments show increased 0.2% yield strength as much as 70–80 kg/mm², which is greater than 35–40 kg/mm² for specimen nos. 24 and 25 without the post heat-treatment, and is more than double that of the Fe-Cr-Al ferritic alloys [specimen no. 32], and even greater than that of Comparative Example 9 [specimen no. 23] of the aged austenitic heat resistive steel SUH-660 [shown in Table 2]. It is also confirmed from the results of Table 3 that the Fe-Cr-Al hot oxidation resistive alloy as represented by Comparative Example 10 [specimen no. 32] sees no appreciable improvement on the mechanical properties by the post heat-treatment subsequent to the scale-forming heat treatment. It is noted that, during the tension test, the alloys of Examples 13 to 20 formed with 8 μm thick $Al_2O_3$ scale saw no crack in the scale within the elastic limit, and that cracks appears when the alloys experience plastic deformation and increases in number as the alloys is deformed further, but no scale flaking was seen in the alloy in that deformed condition.

TABLE 3

| | Specimen No. | composition | Heat Treatment Condition | 0.2% Yield Strength [kg/mm²] | Tensile Strength [kg/mm²] | elongation [%] |
|---|---|---|---|---|---|---|
| Example 13 | 24 | same as speciment No. 2 | hot oxidation treatment (at 1150° C. for 15 hrs) | 35 | 117 | 19 |
| Example 14 | 25 | same as speciment No. 3 | hot oxidation treatment (at 1150° C. for 15 hrs) | 38 | 119 | 15 |
| Example 15 | 26 | same as speciment No. 2 | hot oxidation treatment (at 1150° C. for 15 hrs); + heating at 950° C. for 0.4 hr | 43 | 120 | 28 |

TABLE 3-continued

| | Specimen No. | composition | Heat Treatment Condition | 0.2% Yield Strength [kg/mm²] | Tensile Strength [kg/mm²] | elongation [%] |
|---|---|---|---|---|---|---|
| Example 16 | 27 | same as speciment No. 3 | hot oxidation treatment (at 1150° C. for 15 hrs); + heating at 950° C. for 0.4 hr | 52 | 105 | 13 |
| Example 17 | 28 | same as speciment No. 2 | hot oxidation treatment (at 1150° C. for 15 hrs); + heating at 950° C. for 0.4 hr; + heating at 700° C. for 3 hrs | 70 | 117 | 26 |
| Example 18 | 29 | same as speciment No. 3 | hot oxidation treatment (at 1150° C. for 15 hrs); + heating at 950° C. for 0.4 hr; + heating at 700° C. for 3 hrs | 57 | 111 | 19 |
| Example 19 | 30 | same as speciment No. 2 | hot oxidation treatment (at 1150° C. for 15 hrs); + heating at 950° C. for 0.4 hr; + heating at 500° C. for 7 hrs + heating at 700° C. for 1 hr | 80 | 119 | 24 |
| Example 20 | 31 | same as speciment No. 3 | hot oxidation treatment (at 1150° C. for 15 hrs); + heating at 950° C. for 0.4 hr; + heating at 500° C. for 7 hrs + heating at 700° C. for 1 hr | 72 | 115 | 24 |
| Comparative Example 10 | 32 | same as specimen No. 16 | hot oxidation treatment (at 1150° C. for 15 hrs) | 30 | 57 | 20 |

EXAMPLES 21 TO 26 AND COMPARATIVE EXAMPLE 11

Figure 6A:
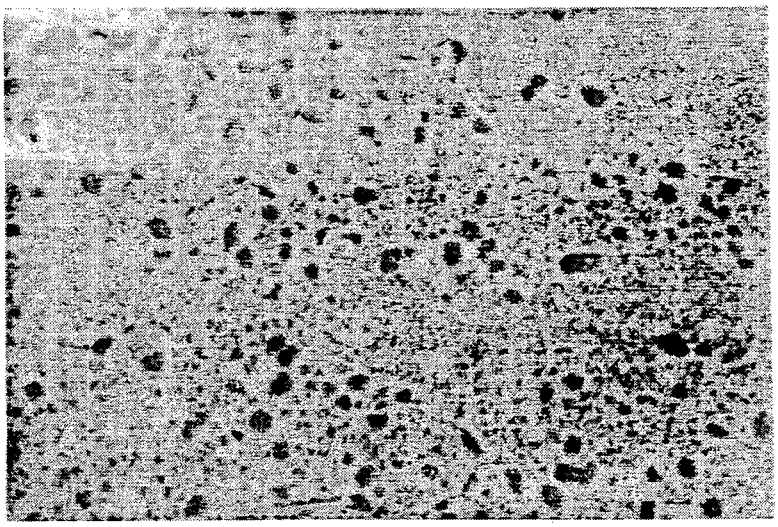
FIGS. 6A and 6B are photographs respectively for the structures of Examples 21 and 25.
Figure 6B:
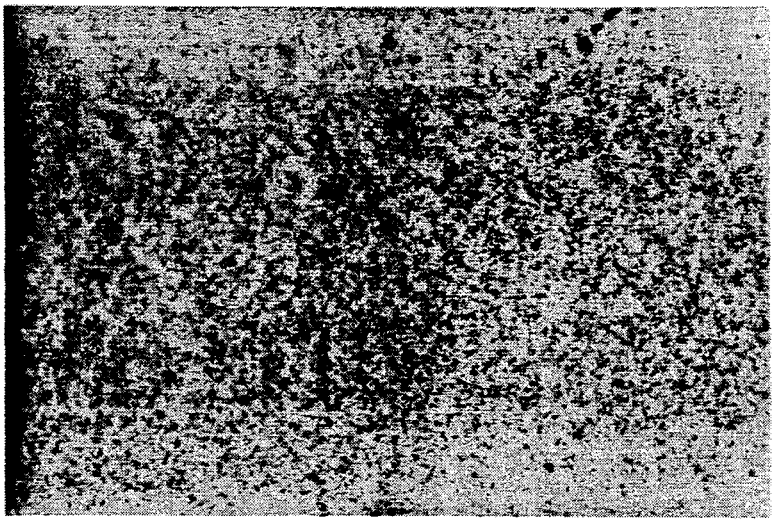

Alloys of the same composition as specimens nos. 2, 3, and 16 were heat-treated at high oxidation temperature of 1150° C. for 15 hours to provide Examples 21 to 26 and Comparative Example 11 in which the aluminum oxide scales were formed. Immediately subsequent to the hot oxidation treatment, Examples 23 to 26 were subjected to post heat-treatments of listed conditions in Table 4 in an attempt to compensate for reduction in hardness expected by the previous hot oxidation treatment. For confirmation, tests were conducted for Examples 21 to 26 [specimen nos. 33 to 38] and Comparative Example 11 [specimen no. 39] to measure hardness [Hv] at room temperature, the results of which are listed in Table 4.

ute Ni-Al intermetallic compounds in the alloy. FIGS. 6A and 6B show microphotographs taken by an optical microscope at a magnification of 700× for internal structures of Example 21 [specimen no. 33] and Example 25 [specimen no. 37]. As seen from these photographs, it is confirmed that Ni-Al compounds of Example 25 with post heat-treatment have a particle size reduced to 0.5 ρm or less, while that of Example 21 has a relatively large particle size of between 1 to 5 μm. Further, even after the above post heat-treatment, no flaking of $Al_2O_3$ scale was observed for Examples 23 to 26.

Test 5: Corrosion Resistance

Alloy of the same composition as specimen no. 2 was heated to a high oxidation temperature of 1150° C. for 15 hours to form the $Al_2O_3$ scale in the surface thereof.

TABLE 4

| | Specimen No. | composition | Heat Treatment Condition | Hardness [Hv] |
|---|---|---|---|---|
| Example 21 | 33 | same as specimen No. 2 | hot oxidation treatment (at 1150° C. for 15 hrs), only | 380 |
| Example 22 | 34 | same as specimen No. 3 | hot oxidation treatment (at 1150° C. for 15 hrs), only | 360 |
| Example 23 | 35 | same as specimen No. 2 | hot oxidation treatment (at 1150° C. for 15 hrs); + heating at 1230° C. for 0.5 hr and air-cooled outside the furnace ## | 520 |
| Example 24 | 36 | same as specimen No. 3 | hot oxidation treatment (at 1150° C. for 15 hrs); + heating at 1230° C. for 0.5 hr and air-cooled outside the furnace ## | 500 |
| Example 25 | 37 | same as specimen No. 2 | hot oxidation treatment (at 1150° C. for 15 hrs); + heating at 1300° C. for 0.1 hr and air-cooled outside the furnace ## | 530 |
| Example 26 | 38 | same as specimen No. 3 | hot oxidation treatment (at 1150° C. for 15 hrs); + heating at 1300° C. for 0.1 hr and air-cooled outside the furnace ## | 500 |
| Comparative Example 11 | 39 | same as specimen No. 16 | hot oxidation treatment (at 1150° C. for 15 hrs), only | 190 |

cooled at a rate of more that 1° C./sec in the atmospheric condition outside the furnace As apparent from Table 4, with the listed post heat-treatments the alloy of the present invention can have remarkably improved hardness of as much as 500 Hv or more, which is very contrast to that the alloys without the post heat-treatment show the hardness of only 360 to 380 Hv. The above improved hardness (500 Hv or more) is two times or more that (190 Hv) of the Fe-Cr-Al alloy of Comparative Example 11 [specimen 39], and further greater than that (330 Hv) of aged austenitic heat resistive steel SUH-660, as indicated in FIG. 4]. Note that the Fe-Cr-Al alloy is experiences no improvement in hardness by the post heat-treatment and is rather softened. The improved hardness of Examples 23 to 26 is thought to result from the precipitation of min- Thereafter, the resulting alloy was immersed in a 5% NaCl aqueous solution in order to measure dissolved amounts of fundamental elements in the solution. In the solution at a temperature of 25° C. for 14 days, each of Fe, Cr, Ni, and Al was only dissolved by an amount of less than 1 ppm. In the solution boiling for 5 hours, Fe was dissolved by an amount of 2.5 ppm and the other elements were each dissolved by an amount of less than 1 ppm. This demonstrates that a very dense $Al_2O_3$ scale is formed in the surface of the alloy to give excellent corrosion resistance against corrosive aqueous solutions.

What is claimed is:

1. A process of preparing an Fe-Cr-Ni-Al ferritic alloy having in its surface an aluminum oxide hot corrosion resistive scale, said process comprising the steps of:

forming an alloy consisting essentially of by weight 25 to 35 percent chromium, 15 to 25 percent nickel; 4 to 8 percent aluminum, 0.05 to 1.0 percent at least one element selected from the group consisting of zirconium, hafnium, cerium, lanthanum, neodymium, gadolinium; not more than 0.1 percent of yttrium; and balance iron;

exposing said alloy to hot oxidation environments at a first temperature of not less than 1000° C. for an extended time in order to form in the surface thereof said aluminum oxide scale chiefly composed of alumina oxide;

heating, immediately subsequent to said hot oxidation, said alloy to a temperature above said first temperature for a relatively short time period; and cooling said alloy to a room temperature.

* * * * *